US010789916B1

(12) United States Patent
Miyajima

(10) Patent No.: US 10,789,916 B1
(45) Date of Patent: Sep. 29, 2020

(54) SNARE DRUM

(71) Applicant: HOSHINO GAKKI CO., LTD., Nagoya, Aichi (JP)

(72) Inventor: Hideyuki Miyajima, Nagoya (JP)

(73) Assignee: HOSHINO GAKKI CO., LTD., Aichi (JP)

( * ) Notice: Subject to any disclaimer, the term of this patent is extended or adjusted under 35 U.S.C. 154(b) by 0 days.

(21) Appl. No.: 16/712,921

(22) Filed: Dec. 12, 2019

(30) Foreign Application Priority Data

Aug. 2, 2019 (JP) ..... 2019-142653

(51) Int. Cl.

| | |
|---|---|
| ***G10D 13/02*** | (2020.01) |
| ***G10D 13/18*** | (2020.01) |
| ***G10D 13/20*** | (2020.01) |
| ***G10D 13/22*** | (2020.01) |

(52) U.S. Cl.
CPC ..... *G10D 13/02* (2013.01); *G10D 13/18* (2020.02); *G10D 13/20* (2020.02); *G10D 13/22* (2020.02)

(58) Field of Classification Search
CPC ..... G10D 13/02; G10D 13/18; G10D 13/22; G10D 13/20
See application file for complete search history.

(56) References Cited

U.S. PATENT DOCUMENTS

| | | | | |
|---|---|---|---|---|
| 5,275,081 | A | 6/1994 | Freer | |
| 5,844,157 | A | 12/1998 | Kasha | |
| 7,741,550 | B2 * | 6/2010 | Miyajima | G10D 13/02 84/415 |
| 2011/0120286 | A1 * | 5/2011 | Good | G10D 13/02 84/415 |

* cited by examiner

*Primary Examiner* — Kimberly R Lockett

(57) ABSTRACT

A snare drum includes a tension adjusting device fixed to a strainer. The tension adjusting device includes a moving member that moves in a direction intersecting inner sound wires of the snare wire. A user can adjust tension of the snare wire by operating the tension adjusting device to cause the moving member to displace the inner sound wires.

12 Claims, 10 Drawing Sheets

SNARE DRUM

BACKGROUND

1. Field

The present invention relates to a snare drum.

2. Description of Related Art

The snare drum includes a shell, a pair of drum heads (a batter head and a bottom head), a snare wire, a strainer, a butt, and the like. The snare wire is fixed to the strainer and the butt with a cord or a strap so as to be attached along the bottom head. In this state, if the strainer is operated, the snare wire is switched to an on position in contact with the bottom head or an off position away from the bottom head. Further, in a state where the snare wire is switched to the on position, if an adjusting screw provided on the strainer or the butt is operated, both ends of the snare wire are pulled to adjust tension of the snare wire. A user checks sound by hitting the batter head while operating the adjusting screw to adjust tension of the snare wire so as to tune the snare drum.

Several snare drums having a plurality of tension adjusting devices as means for adjusting tension of a snare wire have been proposed. For example, a snare drum 100 disclosed in FIG. 10 is configured to be able to separately adjust tension of inner sound wires 101*a* of a snare wire and tension of outer sound wires 101*b* located on both outer sides of the inner sound wires 101*a*. Therefore, an adjusting screw 103*a* for adjusting tension of the inner sound wires 101*a* and an adjusting screw 103*b* for adjusting tension of the outer sound wires 101*b* are assembled to the strainer 102 so as to be adjacent to each other.

In the case of a snare drum 110 disclosed in FIG. 11, three adjustment mechanisms 113*a*, 113*b*, 113*c* for adjusting tension of a snare wire is assembled side by side to a strainer 112. Inner sound wires 111*a* are connected to the adjustment mechanism 113*a* on the center through a cord 114. First outer sound wires 111*b* are connected to the adjustment mechanism 113*b* on the left. Second outer sound wires 111*c* thicker than the first outer sound wires 111*b* are connected to the adjustment mechanism 113*c* on the right.

In addition, each of the snare drums disclosed in U.S. Pat. Nos. 5,275,081 and 5,844,157 includes a snare wire assembly configured so as to be able to separately adjust tension of the entire snare wire and tension of inner sound wires of the snare wire. In the case of U.S. Pat. No. 5,275,081, a fastener is fixed to each of both ends of inner sound wires, and a cable is hooked on the fastener. In addition, at each end section of the snare wire assembly, a first block connected to the lower section of a strainer through a cord, a second block fixed to the first block, and a plate fixed to the second block are provided. Outer sound wires of the snare wire are fixed between the first and second blocks by a pair of bolts. The inner sound wires are fixed between the second block and the plate by one bolt through a cable.

In the case of U.S. Pat. No. 5,844,157, an end fitting body fixed to a lower section of a strainer or a butt through a strap is provided at each of both end sections of the snare wire assembly. In addition, a moving member is movably supported by one of the both end fitting bodies through a bolt and a nut. Both ends of the outer sound wires are fixed to the both end fitting bodies, respectively. One of both ends of the inner sound wires is fixed to the end fitting body, and the other ends of the inner sound wires are fixed to the moving member.

In the cases of the snare drums 100, 110 disclosed in FIGS. 10 and 11, the plurality of tension adjustment mechanisms is provided on the strainers 102, 112. Therefore, the strainers 82, 92 not only require more components but also configurations near the strainers 82, 92 are complicated. In addition, configurations disclosed in FIGS. 10 and 11 can be applied only to the dedicated snare drums 100, 110, and cannot be applied to a general-purpose snare drum having only one tension adjusting device on a strainer. In contrast, the snare wire assemblies disclosed in U.S. Pat. Nos. 5,275,081 and 5,844,157 can also be applied to a general-purpose snare drum.

In the case of U.S. Pat. No. 5,275,081, tension of both the outer sound wires and the inner sound wires can be adjusted by operating an adjusting screw provided on the strainer. However, in the case of only adjusting tension of the inner sound wires without changing the tension of the outer sound wires, in order to adjust the length between the fastener and the plate, troublesome work such as loosening or pulling the cord is required in addition to loosening or tightening the bolt for fixing the second block and the plate. In addition, in the case of U.S. Pat. No. 5,844,157, the moving member that is operated when tension of the inner sound wires is adjusted is disposed on a bottom head. Therefore, since it is difficult to operate the moving member in a state where a batter head is directed upward, tension of the inner sound wires cannot be adjusted well. In addition, since the bolt is small, it is necessary to loosen or tighten the bolt with a screwdriver, and it takes time and effort to operate the moving member. Therefore, in the configurations disclosed in both U.S. Pat. Nos. 5,275,081 and 5,844,157, it is not easy to adjust tension of the snare wire while checking sound by hitting the batter head.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a snare drum is provided. The snare drum includes a shell having a cylindrical shape, a pair of drum heads that are mounted on upper and lower opening ends of the shell through hoops, a snare wire that is attached along the drum head mounted on the lower opening end of the shell and includes a sound wire, a retainer that is provided on an outer peripheral surface of the shell and to which both ends of the snare wire are fixed, and a tension adjusting device that is attached to at least one of the shell, the hoop, the snare wire, and the retainer and adjusts tension of the snare wire. The tension adjusting device is configured to adjust the tension of the snare wire by displacing the sound wire in a direction intersecting the sound wire.

In another general aspect, a snare drum is provided. The snare drum includes a shell having a cylindrical shape, a pair of drum heads that are mounted on upper and lower opening ends of the shell through hoops, a snare wire that is attached along that is the drum head mounted on the lower opening end of the shell and includes a sound wire section that is configured of a plurality of sound wires, and a pair of end fixtures that is fixed to both ends of the sound wire section, and a retainer that is provided on an outer peripheral surface of the shell and to which end sections of the snare wire are fixed. The snare wire is attached along the drum head mounted on the lower opening end of the shell by directly fixing the pair of end fixtures to the retainer.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION OF PREFERRED EMBODIMENTS

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

Hereinafter, an embodiment embodying a snare drum 10 of the present invention will be described with reference to FIGS. 1 to 5.

Figure 1:
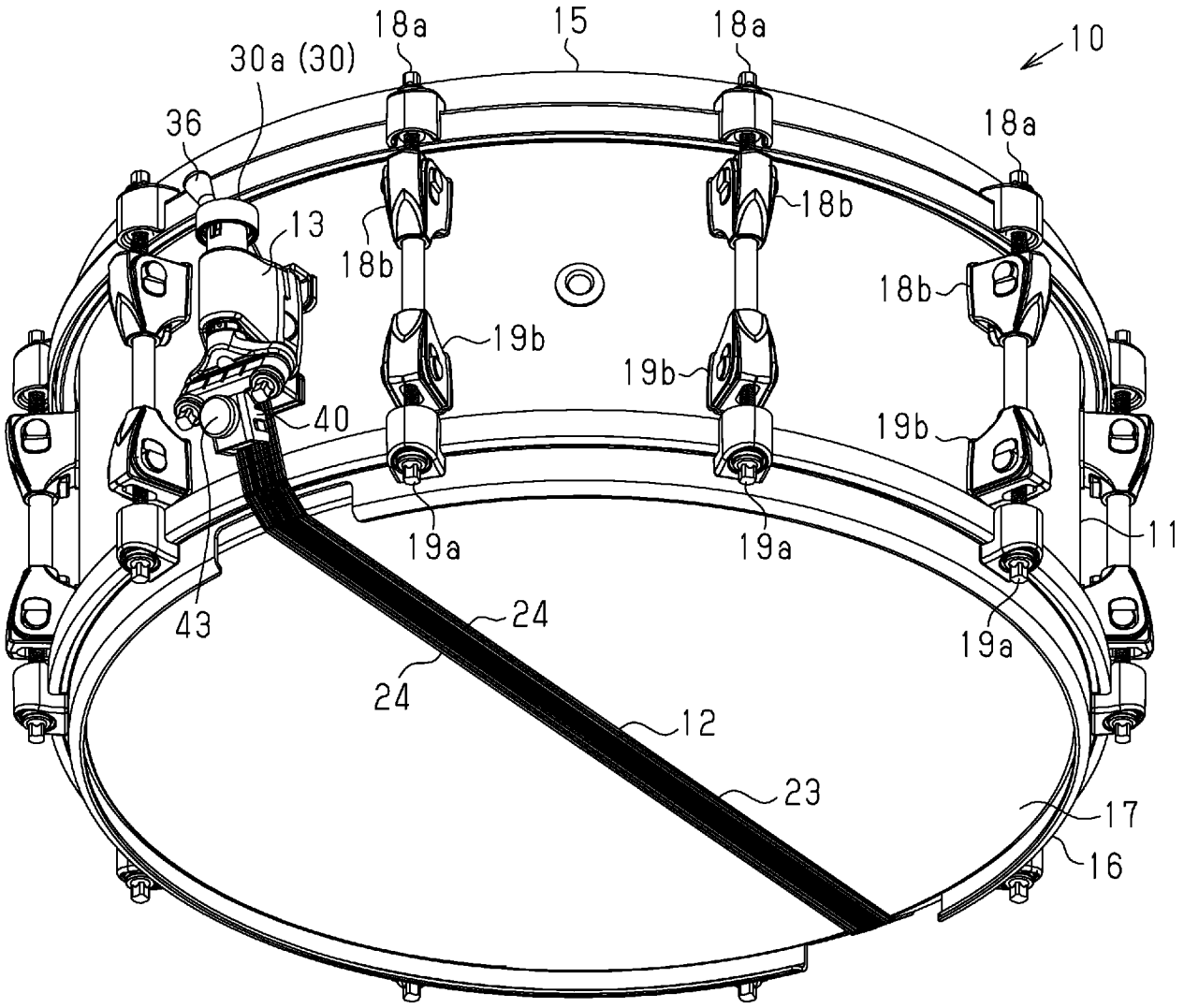
FIG. 1 is a perspective view of a snare drum according to an embodiment of the present invention.

As illustrated in FIG. 1, the snare drum 10 includes a shell 11 having a cylindrical shape, a pair of drum heads, a snare wire 12, a strainer 13, and a butt, not illustrated. The drum head functions as a batter head by being mounted on the upper opening end of the shell 11 together with an upper hoop 15. The drum head functions as a bottom head 17 by being mounted on the lower opening end of the shell 11 together with a lower hoop 16. The strainer 13 and the butt function as a retainer to which both ends of the snare wire 12 are fixed when the snare wire 12 is attached along the bottom head 17. FIG. 1 illustrates the snare drum 10 with the bottom head 17 directed downward.

The snare drum 10 includes first tension bolts 18*a* and first lugs 18*b* to which the first tension bolts 18*a* are screwed. The first tension bolt 18*a* fixes the upper hoop 15 and the batter head at the upper opening end of the shell 11. The snare drum 10 includes second tension bolts 19*a* and second lugs 19*b* to which the second tension bolts 19*a* are screwed. The second tension bolt 19*a* fixes the lower hoop 16 and the bottom head 17 to the lower opening end of the shell 11. The first and second lugs 18*b*, 19*b* are disposed so as to make a pair in the vertical direction. The strainer 13 is fixed to the outer peripheral surface of the shell 11 avoiding the first and second lugs 18*b*, 19*b*. The butt is fixed to the outer peripheral surface of the shell 11 located on the side opposite to the strainer 13.

The first and second lugs 18*b*, 19*b* are disposed at equiangular intervals around the central axis of the shell 11. By tightening or loosening the first tension bolt 18*a* inserted into a screw hole of the first lug 18*b*, the fitting amount of the upper hoop 15 into the shell 11 is changed. Thus, tension of the batter head is changed. Similarly to the above, by tightening or loosening the second tension bolt 19*a* inserted into a screw hole of the second lug 19*b*, the fitting amount of the lower hoop 16 into the shell 11 is changed. Thus, tension of the bottom head 17 is changed.

The snare drum 10 includes a tension adjustment mechanism 30 and a tension adjusting device 40 as means for adjusting tension of the snare wire 12. The tension adjustment mechanism 30 is provided to adjust tension of the entire snare wire 12. The tension adjustment mechanism 30 includes, as an operating unit, an adjusting screw 30*a* provided on an upper section of the strainer 13. The tension adjusting device 40 is provided to adjust tension of the central portion of the snare wire 12. The tension adjusting device 40 includes, as an operating unit, an adjusting screw 43 provided on a lower section of the strainer 13. In a state where the tension adjusting device 40 is attached to the strainer 13, a head section of the adjusting screw 43 is disposed between the lower hoop 16 and the strainer 13.

Figure 2:
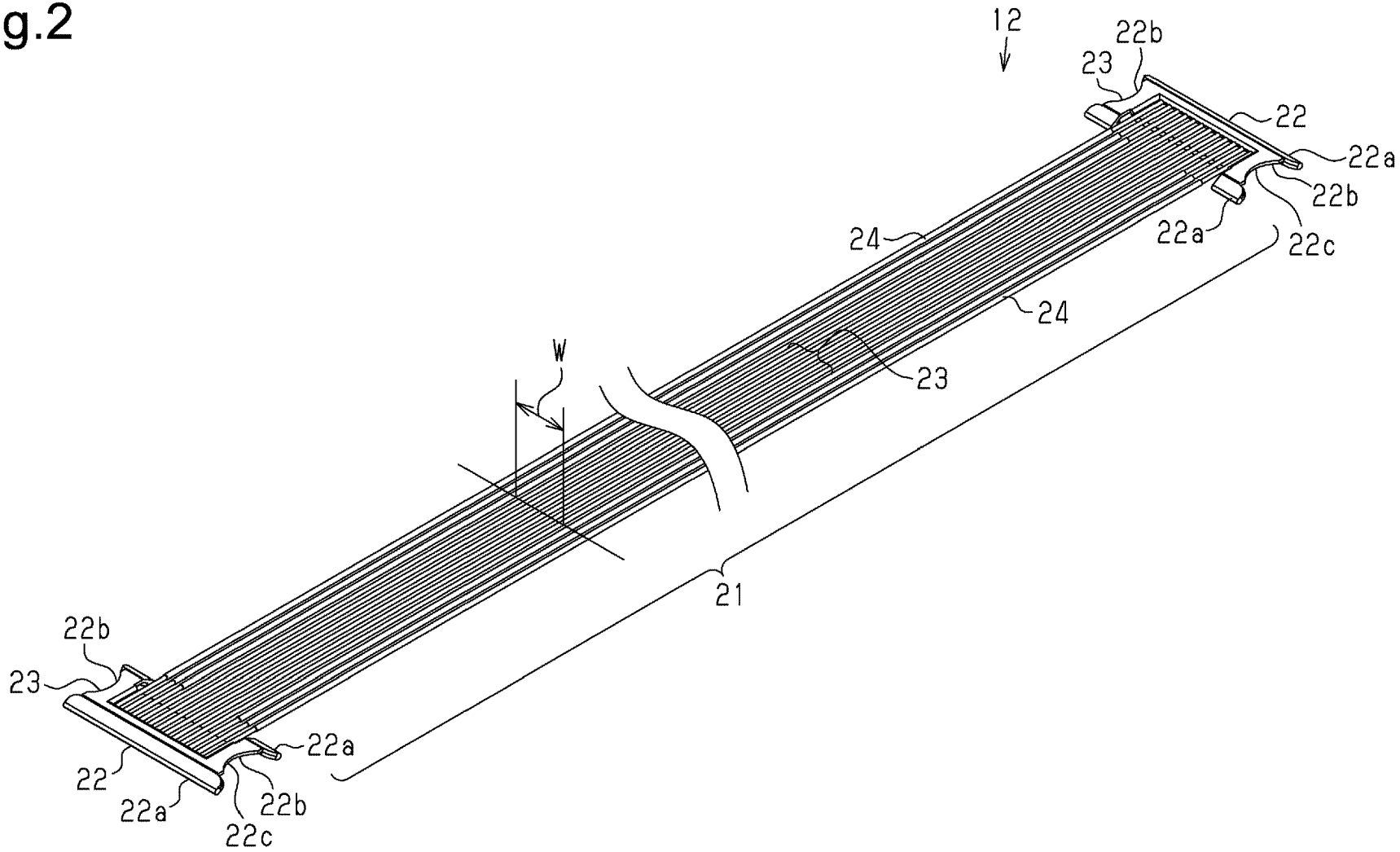
FIG. 2 is a perspective view of a snare wire.

As illustrated in FIG. 2, the snare wire 12 includes a sound wire section 21 configured of a plurality of sound wires, and a pair of end fixtures 22 fixed to both ends of the sound wire section 21. The sound wire section 21 includes inner sound wires 23 located at the center of the sound wire section 21, and outer sound wires 24 located on both outer sides of the inner sound wires 23. Each of the inner sound wires 23 and the outer sound wires 24 is made of a straight wire. Since the inner sound wire 23 is made of a type of straight wire different from the outer sound wire 24, the inner sound wire 23 emits vibration sound different from that of the outer sound wire 24.

The end fixtures 22 are fixed to both end sections of the sound wire section 21 by a joining method such as soldering, welding, or adhesion. The end fixture 22 is formed by bending, into a predetermined shape, a metal plate material punched into a substantially rectangular shape. The end fixture 22 has a pair of first side edges 22*a* disposed so as to face the longitudinal direction of the snare wire 12, and a pair of second side edges 22*b* disposed so as to face the direction orthogonal to the longitudinal axis of the snare wire 12, in a state where the end fixture 22 is fixed to the sound wire section 21. A cutout 22*c* serving as a positioning section is formed in each of the pair of second side edges 22*b*. The cutout 22*c* has a substantially semicircular shape.

Figure 5:
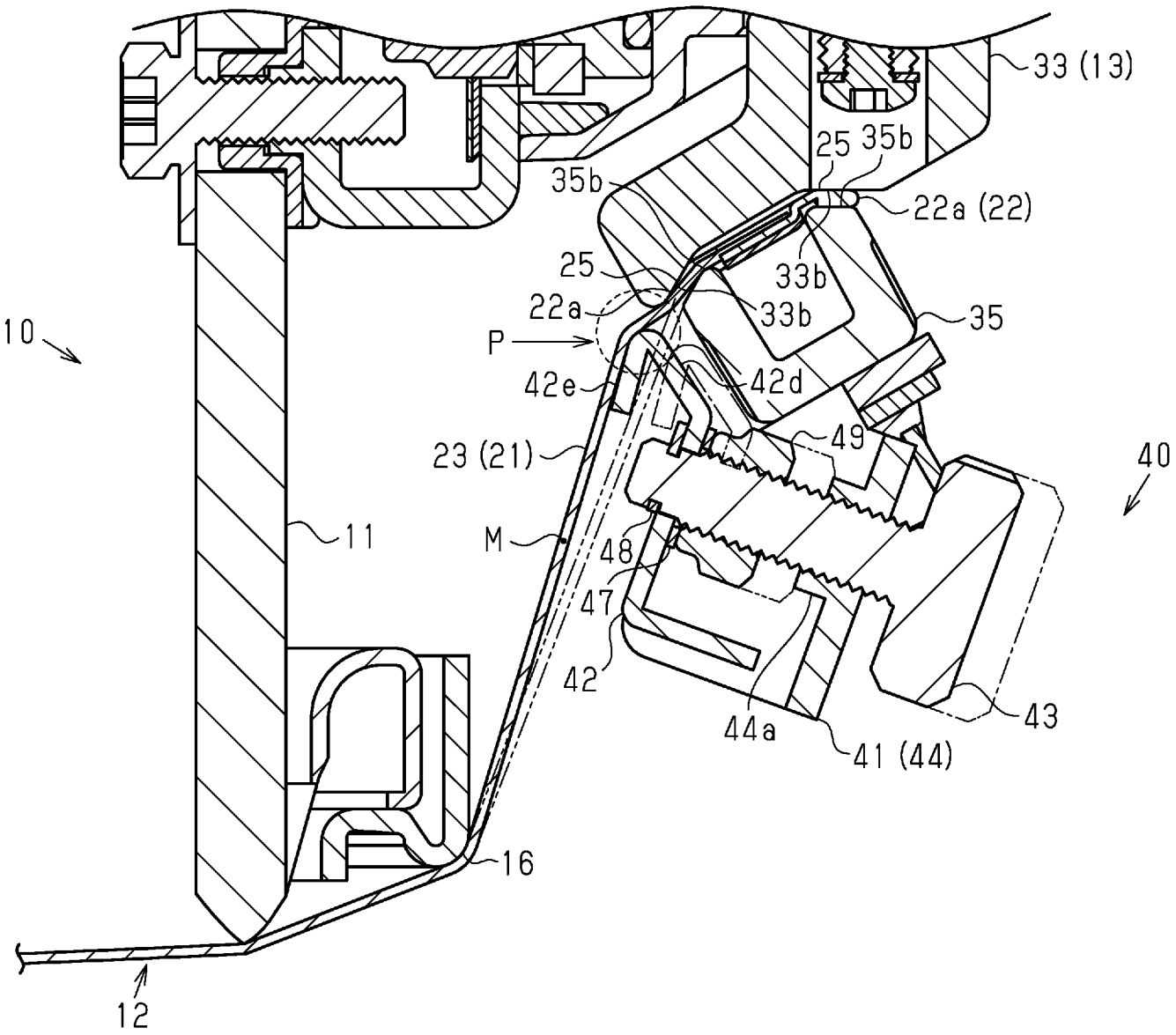
FIG. 5 is a partial cross-sectional view near the tension adjusting device of the snare drum.

As illustrated in FIG. 5, when viewed from the direction orthogonal to the longitudinal axis of the snare wire 12, the end fixture 22 is bent at an obtuse angle near each of the both first side edges 22*a*. Therefore, a tapered section 25 is formed near each of the both first side edges 22*a* of the end fixture 22. The snare wire 12 is attached along the bottom head 17 by directly fixing the both end fixtures 22 to the strainer 13 and the butt, respectively.

Figure 3:
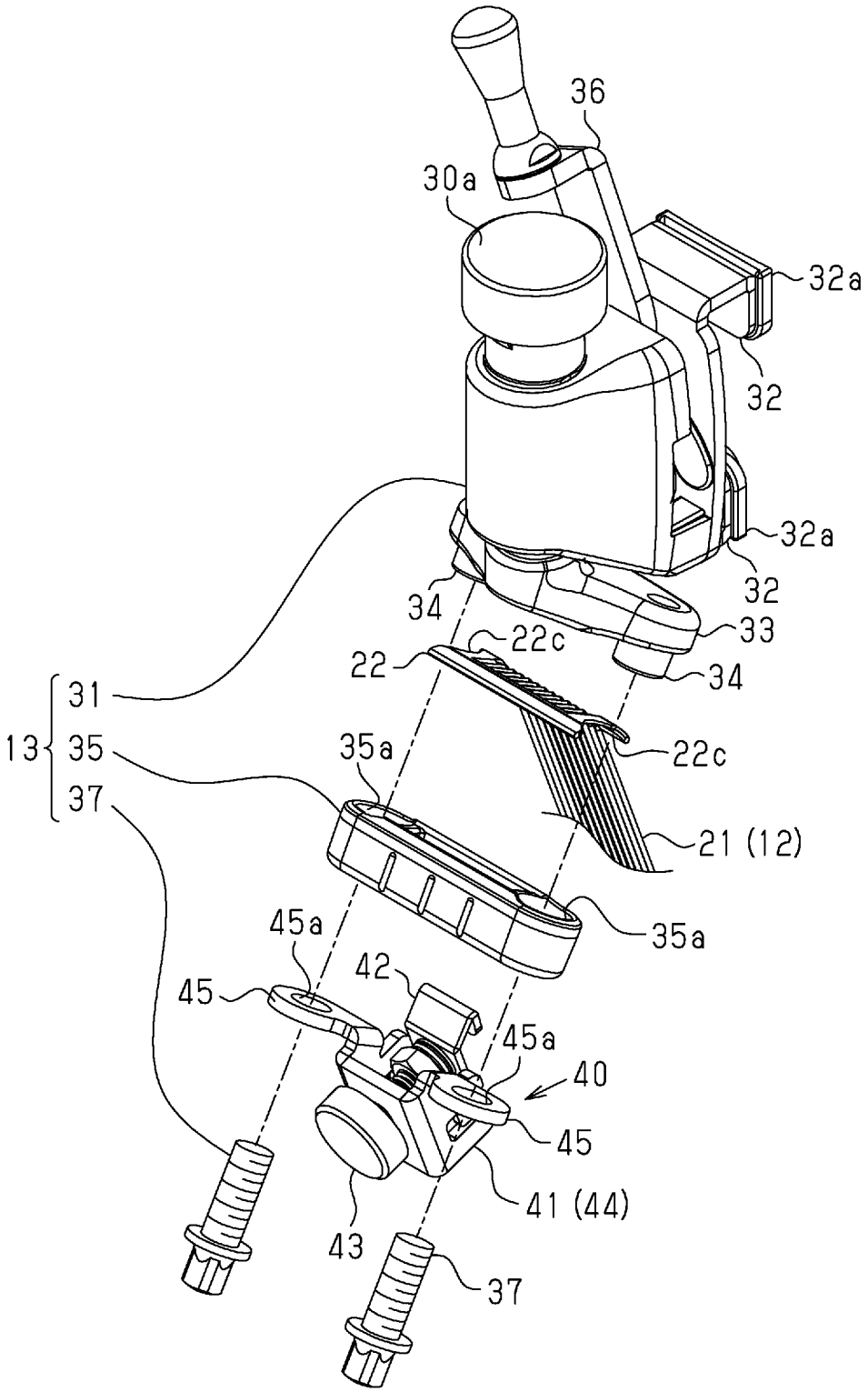
FIG. 3 is a perspective view of a strainer and a tension adjusting device.

As illustrated in FIG. 3, the strainer 13 includes a strainer body 31, a clamping member 35, and a pair of bolts 37 as fixing members. A pair of upper and lower fixing plates 32 that are fixed to the outer peripheral surface of the shell 11 are formed at a rear section of the strainer body 31. A spacer 32*a* is fixed to the surface of each of the fixing plates 32. A holder 33 to which the end fixture 22 of the snare wire 12 is fixed is provided at a lower section the strainer body 31. The holder 33 is attached to the strainer body 31 so as to be movable in the vertical direction.

Projecting sections 34 project downward from both end sections of the holder 33, respectively. The projecting section 34 has a columnar shape and has a female screw therein. The clamping member 35 has a pair of insertion holes 35*a* provided at locations corresponding to the projecting sections 34 of the holder 33. In addition, the insertion holes 35*a* of the clamping member 35 and the projecting sections 34 of the holder 33 are formed at locations corresponding to the cutouts 22*c* of the end fixture 22 held between the holder 33 and the clamping member 35.

The pair of bolts 37 inserted from below into the insertion holes 35*a* of the clamping member 35 are fastened to the female screws of the projecting sections 34 of the holder 33, and thus the end fixture 22 is fixed between the holder 33 and the clamping member 35. At this time, the projecting section 34 is inserted into the insertion hole 35*a* of the clamping member 35. The projecting section 34 of the holder 33 and the insertion hole 35*a* of the clamping member 35 function as a connecting portion that connects the clamping member 35 and the holder 33. As a result, the snare wire 12 is fixed to the holder 33 from below by using the clamping member 35 and the bolts 37.

As illustrated in FIG. 5, when viewed from the direction orthogonal to the longitudinal axis of the snare wire 12, the holder 33 has inclined surfaces 33*b* at portions corresponding to the tapered sections 25 of the end fixture 22. Similarly, the clamping member 35 also has inclined surfaces 35*b* at portions corresponding to the tapered sections 25 of the end fixture 22. The inclined surfaces 33*b*, 35*b* of the holder 33 and the clamping member 35 are inclined at an angle identical to that of the tapered section 25 of the end fixture 22. Therefore, when the end fixture 22 is clamped between the holder 33 and the clamping member 35, movement of the snare wire 12 in the longitudinal direction is restricted by the tapered sections 25 and the inclined surfaces 33*b*, 35*b* of the holder 33 and the clamping member 35. Although not illustrated, the structure for fixing the snare wire 12 to the butt is similar to the above-described structure.

As illustrated in FIG. 3, on an upper section of the strainer body 31, an operation lever 36 is provided adjacent to the adjusting screw 30*a*. The operation lever 36 is operated when the position of the snare wire 12 fixed to the holder 33 is switched to an off position separated from the bottom head 17 or an on position in contact with the bottom head 17. The adjusting screw 30*a* is operated when the position of the holder 33 in the vertical direction is changed in order to adjust tension of the snare wire 12. If the adjusting screw 30*a* is turned clockwise, the holder 33 moves upward and the both ends of the snare wire 12 are pulled. Therefore, tension of the snare wire 12 is increased. If the adjusting screw 30*a* is turned counterclockwise, the holder 33 moves downward. Therefore, tension of the snare wire 12 is weakened. That is, the adjusting screw 30*a* forms part of the tension adjustment mechanism 30 together with the holder 33.

The tension adjusting device 40 is fixed to the strainer 13 from below together with the snare wire 12 and the clamping member 35, by using the pair of bolts 37. The tension adjusting device 40 includes a base member 41, a moving member 42, and an adjusting screw 43. The base member 41 includes a body section 44 having a U-shaped cross section, and a pair of right and left fixing sections 45 projecting from the upper section of the body section 44. An insertion hole 45*a* through which the bolt 37 is inserted is formed in the fixing section 45. The tension adjusting device 40 is fixed to the clamping member 35 from below by fastening the pair of bolts 37 inserted through the fixing sections 45 to the female screws of the projecting sections 34 of the holder 33.

Figure 4:
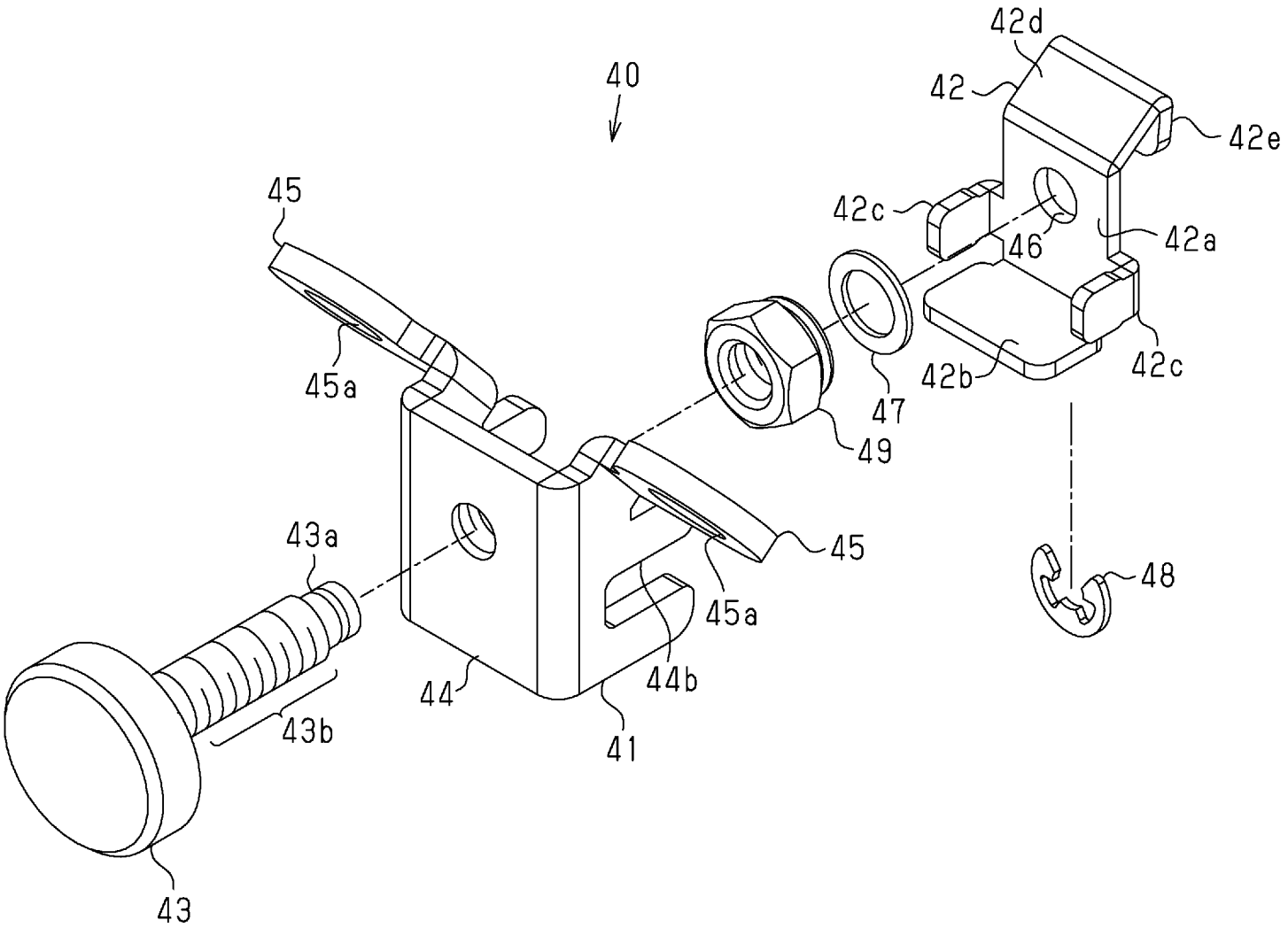
FIG. 4 is an exploded perspective view of the tension adjusting device.

As illustrated in FIGS. 4 and 5, a projecting section 44*a* that projects inside the body section 44 is provided at the center of the body section 44. A female screw into which the adjusting screw 43 is screwed and inserted is formed in the projecting section 44*a*. On each of both side walls of the body section 44, a groove 44*b* extending from the front end toward the base end of each side wall is formed. In a state where the tension adjusting device 40 is attached to the strainer 13, the groove 44*b* is disposed so as to face a direction substantially orthogonal to the sound wire section 21 of the snare wire 12.

The moving member 42 is formed by bending into a substantially S shape, a metal plate material punched into a substantially rectangular shape. The moving member 42 has a central section 42*a*, a lower section 42*b* bent at a right angle with respect to the central section 42*a*, and a pair of side sections 42*c*. Each of the both side sections 42*c* has substantially the same shape as that of the groove 44*b* of the base member 41, and has a smaller width and length than the groove 44*b*. The moving member 42 is slidably assembled to the base member 41 by disposing the lower section 42*b* between the both side walls of the body section 44 and engaging the both side sections 42*c* with the grooves 44*b*.

In a state where the moving member 42 is assembled to the base member 41, the both side walls of the body section 44 restrict movement of the moving member 42 in the lateral direction, and the grooves 44*b* restrict movement of the moving member 42 in the vertical direction. In addition, in a state where the tension adjusting device 40 is attached to the strainer 13, the groove 44*b* is disposed so as to face the direction substantially orthogonal to the sound wire section 21 of the snare wire 12. Therefore, the both side walls and the grooves 44*b* of the body section 44 function as guide sections that guide movement of the moving member 42 relative to the base member 41 in the direction substantially orthogonal to the sound wire section 21.

An insertion hole 46 through which a front end of the adjusting screw 43 is inserted is formed in the central section 42*a*. The adjusting screw 43 is screwed into the female screw of the projecting section 44*a* of the base member 41 and is inserted through the insertion hole 46 of the moving member 42. The moving member 42 is held so as not to come off from the adjusting screw 43 by an e-ring 48 fitted in a circumferential groove 43*a* formed at a front end section of the adjusting screw 43. In addition, the moving member 42 is fixed to the front end section of the adjusting screw 43 by tightening a nut 49 screwed into a screw section 43*b* of the adjusting screw 43. A flat washer 47 is fitted into the screw section 43*b* between the moving member 42 and the nut 49 in order to reduce sliding resistance between the moving member 42 and the nut 49.

The moving member 42 is assembled to the base member 41 so as to move forward by turning the adjusting screw 43 clockwise, and to move backward by turning the adjusting screw 43 counterclockwise. The moving direction of the moving member 42 is limited to the direction substantially orthogonal to the sound wire section 21 of the snare wire 12 by the both side walls and the grooves 44*b* of the body section 44. Forward movement of the moving member 42 is restricted by the head section of the adjusting screw 43 coming into contact with the base member 41. Backward movement of the moving member 42 is restricted by the both side sections 42*c* of the moving member 42 coming into contact with the bottom surfaces of the grooves 44*b*.

The moving member 42 further includes an upper section 42*d* bent at an obtuse angle with respect to the central section 42*a*, and a front end section 42*e* bent at an acute angle with respect to the upper section 42*d*. The front end section 42*e* is a portion that presses the inner sound wires 23 of the snare wire 12, and has a width equivalent to the arrangement width W of the inner sound wires 23 illustrated in FIG. 2. In a state where the tension adjusting device 40 is attached to the strainer 13, the front end section 42*e* is disposed at a location closer to the strainer 13 with respect to an intermediate point M between the lower hoop 16 and the strainer 13. Specifically, the front end section 42*e* is disposed near the lower end section of the holder 33. As can be seen from a portion P surrounded by a dotted line in FIG. 5, the position of the front end section 42*e* is adjusted to a position where the inner sound wires 23 are not rubbed by an end of the front end section 42*e*. Specifically, the position of the front end section 42*e* is adjusted such that the inner sound wires 23 are pressed from the outside by a portion away from the end of the front end section 42*e*, that is, a rounded boundary portion between the upper section 42*d* and the front end section 42*e*.

Next, operation procedures for adjusting tension of the snare wire 12 by the tension adjusting device 40 as an operation of the snare drum 10 described above will be described with reference to FIGS. 1 and 5.

Before adjusting tension of the snare wire 12 by the tension adjusting device 40, first, the operation lever 36 illustrated in FIG. 1 is operated to switch the position of the snare wire 12 fixed to the holder 33 to the on position. Subsequently, the adjusting screw 30*a* provided on the strainer 13 is turned clockwise to increase tension of the snare wire 12 or the adjusting screw 30*a* is turned counterclockwise to weaken tension of the snare wire 12. At this time, tension of the entire snare wire 12 is adjusted by the tension adjustment mechanism 30 by operating the adjusting screw 30*a*. In addition, at this time, a user operates the adjusting screw 30*a* while checking sound by hitting the batter head.

Next, the tension adjusting device 40 is operated to adjust only tension of the inner sound wires 23 without changing tension of the outer sound wires 24. A two-dot chain line in FIG. 5 illustrates a state where the moving member 42 has moved backward and the front end section 42*e* of the moving member 42 is separated from the inner sound wires 23. From this state, the adjusting screw 43 is turned clockwise to move the moving member 42 forward. Then, the moving member 42 moves in the direction substantially orthogonal to the inner sound wires 23, and the front end section 42*e* approaches the inner sound wires 23.

A solid line in FIG. 5 illustrates a state after the moving member 42 has moved forward and therefore the front end section 42*e* comes into contact with the inner sound wires 23. At this time, the front end section 42*e* applies a pressing force to the inner sound wires 23 in the direction substantially orthogonal to the inner sound wires 23. Therefore, the front end section 42*e* displaces the inner sound wires 23 in the direction intersecting the inner sound wires 23 from the state indicated by two-dot chain lines in FIG. 5. As a result, tension corresponding to the displacement amount of the inner sound wires 23 is applied to the inner sound wires 23. In the case of adjusting tension of the inner sound wires 23, the adjusting screw 43 is operated to adjust the displacement amount of the inner sound wires 23. Specifically, in the case of increasing tension of the inner sound wires 23, the adjusting screw 43 is turned clockwise to increase the displacement amount of the inner sound wires 23. In the case of weakening tension of the inner sound wires 23, the adjusting screw 43 is turned counterclockwise to decrease the displacement amount of the inner sound wires 23.

In the series of operation procedures described above, the tension adjustment mechanism 30 and the tension adjusting device 40 are operated to adjust sound of the snare wire 12. Here, the relationship between the turning direction of the adjusting screw 43 by the tension adjusting device 40 and the strength of tension of the inner sound wires 23 is identical to the relationship between the turning direction of the adjusting screw 30*a* by the tension adjustment mechanism 30 and the strength of the tension of the entire snare wire 12. That is, the turning directions of the adjusting screws 30*a*, 43 with respect to the strength of the tension are unified. Therefore, a user can adjust tension of the snare wire 12 while alternately operating the tension adjustment mechanism 30 and the tension adjusting device 40.

Therefore, according to the present embodiment, the following effects can be obtained.

(1) The snare drum 10 includes the tension adjusting device 40 as means for adjusting tension of the snare wire 12. The tension adjusting device 40 is configured to displace the inner sound wires 23 in the direction intersecting the inner sound wires 23 by the front end section 42*e*. According to this configuration, it is possible to apply tension to the inner sound wires 23 by the front end section 42*e*. Therefore, tension of the inner sound wires 23 can be adjusted by adjusting the displacement amount of the inner sound wires 23 displaced by the front end section 42*e*.

(2) The tension adjusting device 40 includes the moving member 42 including the front end section 42*e* and the adjusting screw 43 operated when the moving member 42 is moved. According to this configuration, a user can adjust tension of the inner sound wires 23 by turning the adjusting screw 43 to displace the inner sound wires 23 by the front end section 42*e*. In addition, in a state where the tension adjusting device 40 is attached to the strainer 13, the head section of the adjusting screw 43 is disposed between the lower hoop 16 and the strainer 13. In this case, the head section of the adjusting screw 43 can be disposed at a position where it is easy for a user to see and operate the head section in a state where the batter head is directed upward after the tension adjusting device 40 is attached to the strainer 13. Therefore, it becomes easy to operate the tension adjusting device 40 while checking sound by hitting the batter head. As a result, the tension adjustment operation of the snare wire 12 becomes easy.

(3) When the snare wire 12 is switched from the on position to the off position, tension applied to the sound wire section 21 is lost, and the entire sound wire section 21 is loosened. Therefore, when the snare wire 12 is returned to the on position, the inner sound wires 23 are likely to drop off from the moving member 42, and there is a possibility that the operation of displacing the inner sound wires 23 by the moving member 42 may be hindered. In this regard, according to the present embodiment, in a state where the tension adjusting device 40 is attached to the strainer 13, the front end section 42*e* of the moving member 42 is disposed at a location closer to the strainer 13 with respect to the intermediate point M between the lower hoop 16 and the strainer 13, specifically near the lower end section of the holder 33. Therefore, even if the snare wire 12 is switched to the off position, the inner sound wires 23 near the holder 33 hardly loosen. As a result, the inner sound wires 23 hardly drop off from the front end section 42*e* of the moving member 42 when the snare wire 12 is returned to the on position. Therefore, even if the tension adjusting device 40 is repeatedly operated, the operation of displacing the inner sound wires 23 by the moving member 42 can be kept satisfactorily.

(4) The snare drum 10 includes the tension adjustment mechanism 30 that adjusts tension of the entire snare wire 12, and the tension adjusting device 40 that adjusts tension of only the inner sound wires 23 of the snare wire 12. That is, the tension adjusting device 40 is configured to adjust the tension of part of the snare wire 12. According to this configuration, a user can adjust tension of the entire snare wire 12 by operating the tension adjustment mechanism 30, and can adjust tension of part of the snare wire 12 by operating the tension adjusting device 40. Thus, by operating the tension adjustment mechanism 30 and the tension adjusting device 40 in combination, sound of the snare wire 12 can be finely adjusted, and thus sound of the snare drum 10 can be finely adjusted.

(5) The tension adjusting device 40 is fixed to the strainer 13. In the snare drum 10, it is possible to make hitting sound resonate by vibrating the shell 11, the upper hoop 15, the lower hoop 16, the snare wire 12, and the like, in addition to the drum head. In this regard, if the tension adjusting device 40 is fixed to the strainer 13, the influence on sound of the snare drum 10 due to the tension adjusting device 40 being attached to the strainer 13 can be suppressed. In addition, in this case, since the on/off operation of the snare wire 12 and the tension adjusting operation can be performed by the same section, the snare drum 10 can be easily tuned.

(6) The snare wire 12 is fixed to the holder 33 from below by using the clamping member 35 and the bolts 37. In addition, the tension adjusting device 40 is fixed to the clamping member 35 from below by using the pair of bolts 37. According to this configuration, the bolt 37 has a function of fixing the snare wire 12 to the strainer 13 and a function of fixing the tension adjusting device 40 to the strainer 13. Therefore, since an increase in the number of components can be suppressed, the configurations near the tension adjusting device 40 and the strainer 13 are not complicated. In addition, according to the present embodiment, the strainer 13 includes the tension adjustment mechanism 30 that adjusts tension of the entire snare wire 12. In this case, by operating the adjusting screw 30*a* of the tension adjustment mechanism 30 to move the holder 33 up and down, the tension adjusting device 40 fixed to the holder 33 also moves up and down. Therefore, it is possible to adjust tension of the inner sound wires 23 of the snare wire 12 by operating the tension adjusting device 40, after adjusting tension of the entire snare wire 12 by operating the tension adjustment mechanism 30. That is, the master-slave relationship between tension adjustment by the tension adjusting device 40 and tension adjustment by the tension adjustment mechanism 30 can be clarified.

(7) In a state where the tension adjusting device 40 is attached to the strainer 13, the grooves 44*b* are disposed so as to face the direction substantially orthogonal to the sound wire section 21 of the snare wire 12. In addition, the moving member 42 is slidably assembled to the base member 41 by engaging the both side sections 42*c* with the grooves 44*b*. Therefore, the moving member 42 can be assembled to the base member 41 so as to be slidable in the direction substantially orthogonal to the sound wire section 21. Therefore, it becomes easy to move the moving member 42 in the direction substantially orthogonal to the sound wire section 21, and it becomes easy to apply tension to the sound wire section 21 by the moving member 42.

(8) The snare wire 12 is attached along the bottom head 17 by directly fixing the both end fixtures 22 to the strainer 13 and the butt, respectively. According to this configuration, since the snare wire 12 is directly fixed to the strainer 13 through the end fixture 22, no cord or strap for attaching the snare wire 12 to the strainer 13 is required. In addition, in this case, tension of the snare wire 12 immediately after the snare wire 12 is attached to the strainer 13 is identical to tension of the snare wire 12 before the snare wire 12 is removed from the strainer 13. Therefore, in a case where the snare wire 12 is removed in order to replace the bottom head 17, sound of the snare drum 10 can be reproduced only by directly fixing the snare wire 12 to the strainer 13 and the butt by the both end fixtures 22. As a result, the operation of adjusting tension of the snare wire 12 by operating the adjusting screws 30*a*, 43 is not necessary in order to reproduce sound of the snare drum 10.

(9) When the end fixture 22 of the snare wire 12 is attached to the holder 33, the tapered section 25 is clamped between the inclined surfaces 33*b*, 35*b* of the holder 33 and the clamping member 35, at the first side edge 22*a* of the end fixture 22. As a result, the end fixture 22 does not move in the longitudinal direction of the snare wire 12. Therefore, the positioning of the end fixture 22 with respect to the holder 33 is becomes easy, and the mounting operation of the snare wire 12 to the strainer 13 becomes easy. In this case, the tapered sections 25, and the both inclined surfaces 33*b*, 35*b* of the holder 33 and the clamping member 35 function as positioning sections.

(10) When the end fixture 22 of the snare wire 12 is attached to the holder 33, the projecting section 34 is engaged with the cutout 22*c* at the second side edge 22*b* of the end fixture 22. Therefore, the end fixture 22 does not move in the direction orthogonal to the longitudinal axis of the snare wire 12. Therefore, the positioning of the end fixture 22 with respect to the holder 33 is becomes easy, and the mounting operation of the snare wire 12 to the strainer 13 becomes easy. In this case, the cutout 22*c*, which is a recess, and the projecting section 34 inserted into the insertion hole 35*a* of the clamping member 35 function as a positioning section.

The present embodiment may be modified as follows.

In the present embodiment, the tension adjustment mechanism 30 may be omitted from the snare drum 10. That is, the tension adjusting device 40 may be used to adjust tension of the entire snare wire 12, that is, both the tension of the inner sound wires 23 and tension of the outer sound wires 24. In this case, the configuration of the tension adjusting device 40 can be replaced with a conventional configuration of adjusting tension of a snare wire by pulling sound wires. As a result, a cord or a strap, and a complex configuration and component for pulling the cord or the strap are unnecessary. Therefore, by using the tension adjusting device 40, tension of the snare wire 12 can be adjusted with a simple configuration.

Figure 6:
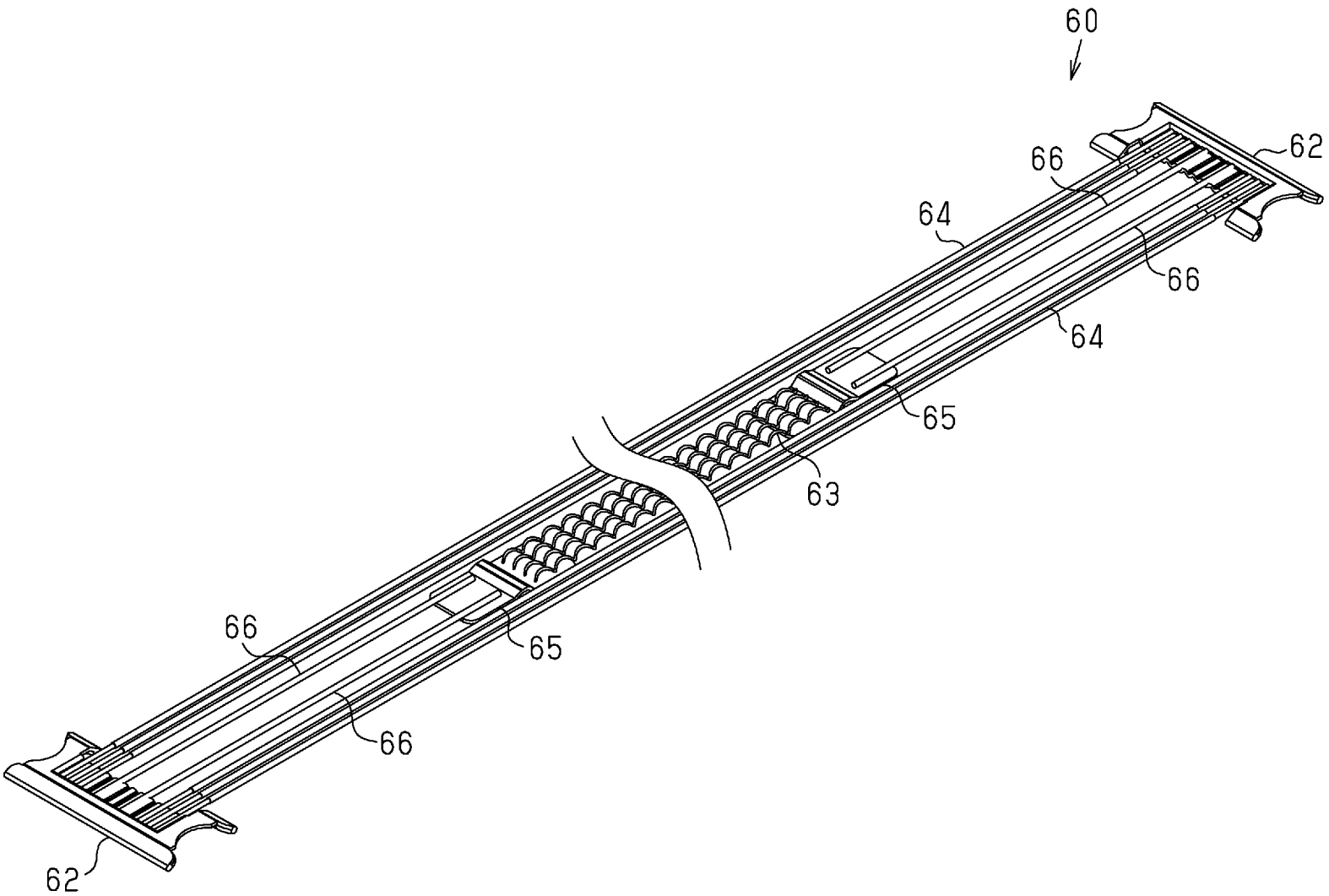
FIG. 6 is a perspective view of a snare wire according to another example.

In the present embodiment, a snare wire 60 illustrated in FIG. 6 can also be applied to the snare drum 10. The snare wire 60 includes inner sound wires 63 made of coil wires, outer sound wires 64 made of straight wires, and a pair of end fixtures 62. Fasteners 65 are fixed to both ends of the inner sound wires 63. Two cords 66 are fixed to the fastener 65. The inner sound wires 63 are fixed to the end fixtures 62 through the fasteners 65 and the cords 66. In this case, a tension adjusting device 40 is configured to displace the cords 66 in the direction intersecting the cords 66 by a front end section 42*e*. According to this configuration, it is possible to apply tension to the inner sound wires 63 through the cords 66 by using the front end section 42*e*. Therefore, tension of the inner sound wires 63 can be adjusted by adjusting the displacement amount of the cord 66 displaced by the front end section 42*e*.

Figure 7:
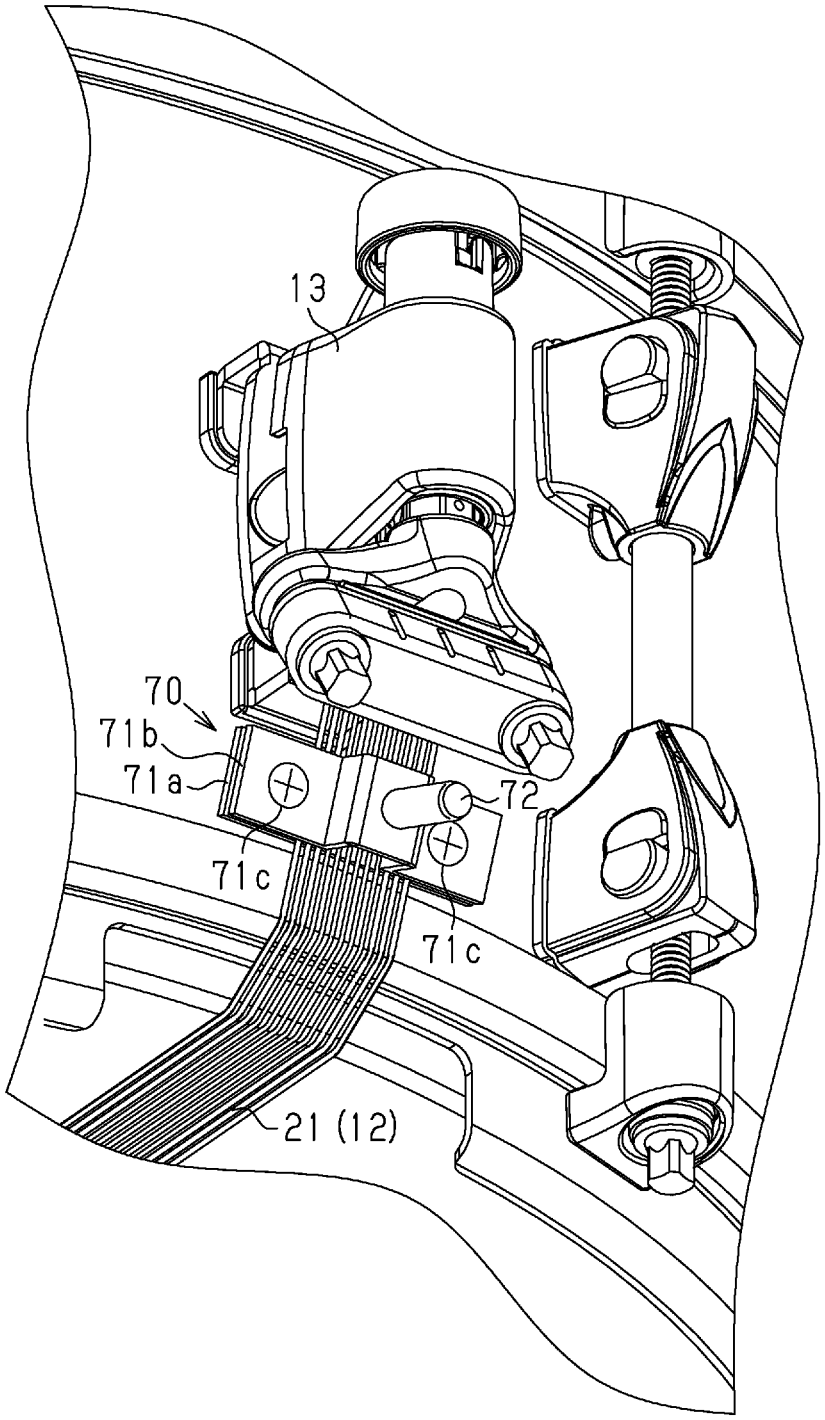
FIG. 7 is a perspective view of a tension adjusting device according to another example.

In the present embodiment, the tension adjusting device 40 is fixed together with the snare wire 12, to the holder 33 provided at the lower section of the strainer 13. In lieu of this, as illustrated in FIG. 7, a tension adjusting device 70 may be directly fixed to a sound wire section 21 of a snare wire 12. The tension adjusting device 70 includes a pair of plates 71*a*, 71*b* that clamp the sound wire section 21, fixing screws 71*c* that fix the both plates 71*a*, 71*b*, and a moving member 72 that presses the sound wire section 21. In addition, the tension adjusting devices 40, 70 may be attached to the shell 11, the upper hoop 15, the lower hoop 16, or the butt in addition to the strainer 13 or the snare wire 12, or may be attached so as to straddle this plurality of components.

Figure 8:
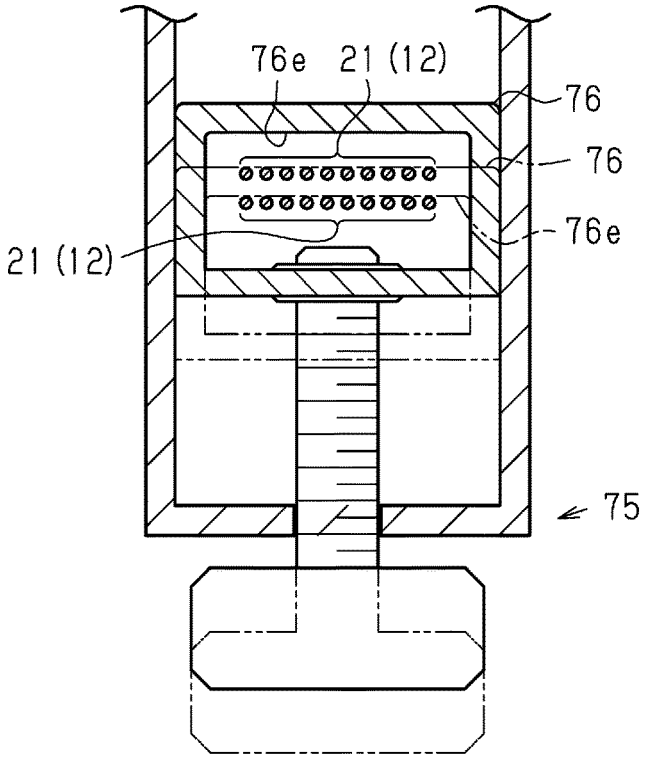
FIG. 8 is a schematic cross-sectional view of a tension adjusting device according to another example.

In the present embodiment, the tension adjusting device 40 is configured to adjust tension of the inner sound wires 23 by pressing the inner sound wires 23 by the moving member 42. In lieu of this, as illustrated in FIG. 8, a tension adjusting device 75 may be configured to adjust tension of a snare wire 12 by pulling a sound wire section 21 in a direction orthogonal to the sound wire section 21 by a moving member 76. Solid lines in FIG. 8 illustrate a state where the moving member 76 moves forward and a front end section 76*e* of the moving member 76 is separated from the sound wire section 21. Two-dot chain lines in FIG. 8 illustrate a state where the moving member 76 has moved backward and the front end section 76*e* of the moving member 76 is brought into contact with the sound wire section 21 and pulls the sound wire section 21 from inside.

Figure 9:
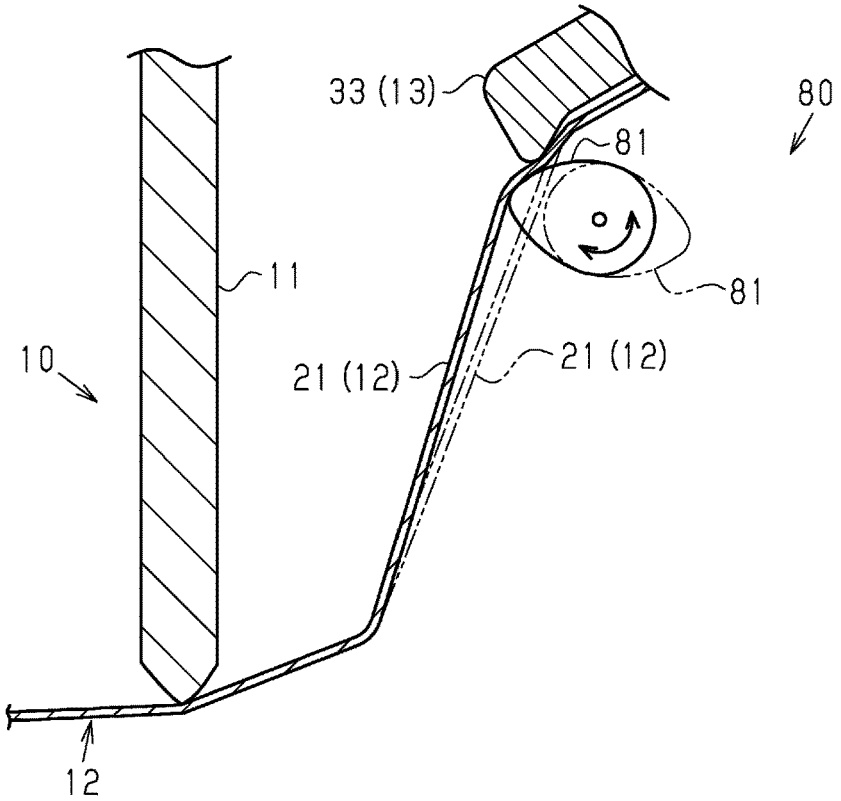
FIG. 9 is a schematic cross-sectional view of a tension adjusting device according to another example.
Figure 10:
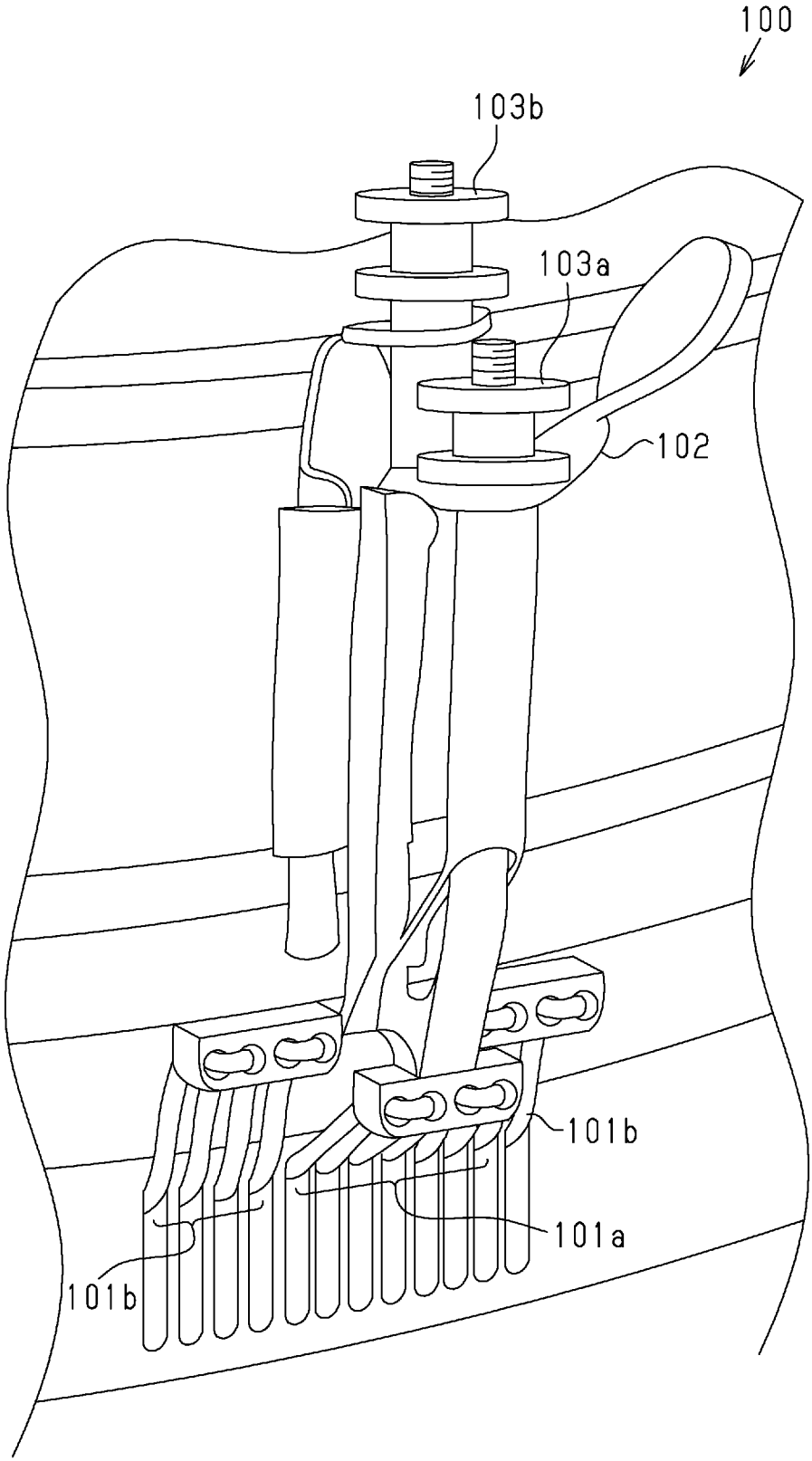
Fig.10(Related Art)
FIG. 10 is a perspective view of a conventional tension adjusting device.

In addition, as illustrated in FIG. 9, a tension adjusting device 80 may be configured to adjust tension of a snare wire 12 by pressing a sound wire section 21 in a direction intersecting the sound wire section 21 by a cam 81.

In the present embodiment, the tension adjusting device 40 is used to adjust tension of the inner sound wires 23 of the snare wire 12. In lieu of this, the tension adjusting device 40 may be configured to be able to adjust tension of the outer sound wires 24, or may be configured to be able to adjust both of tension of the inner sound wires 23 and tension of the outer sound wires 24. In this case, the number of front end sections 42*e* of the moving member 42 may be increased or the width of the front end section 42*e* may be changed.

Figure 11:
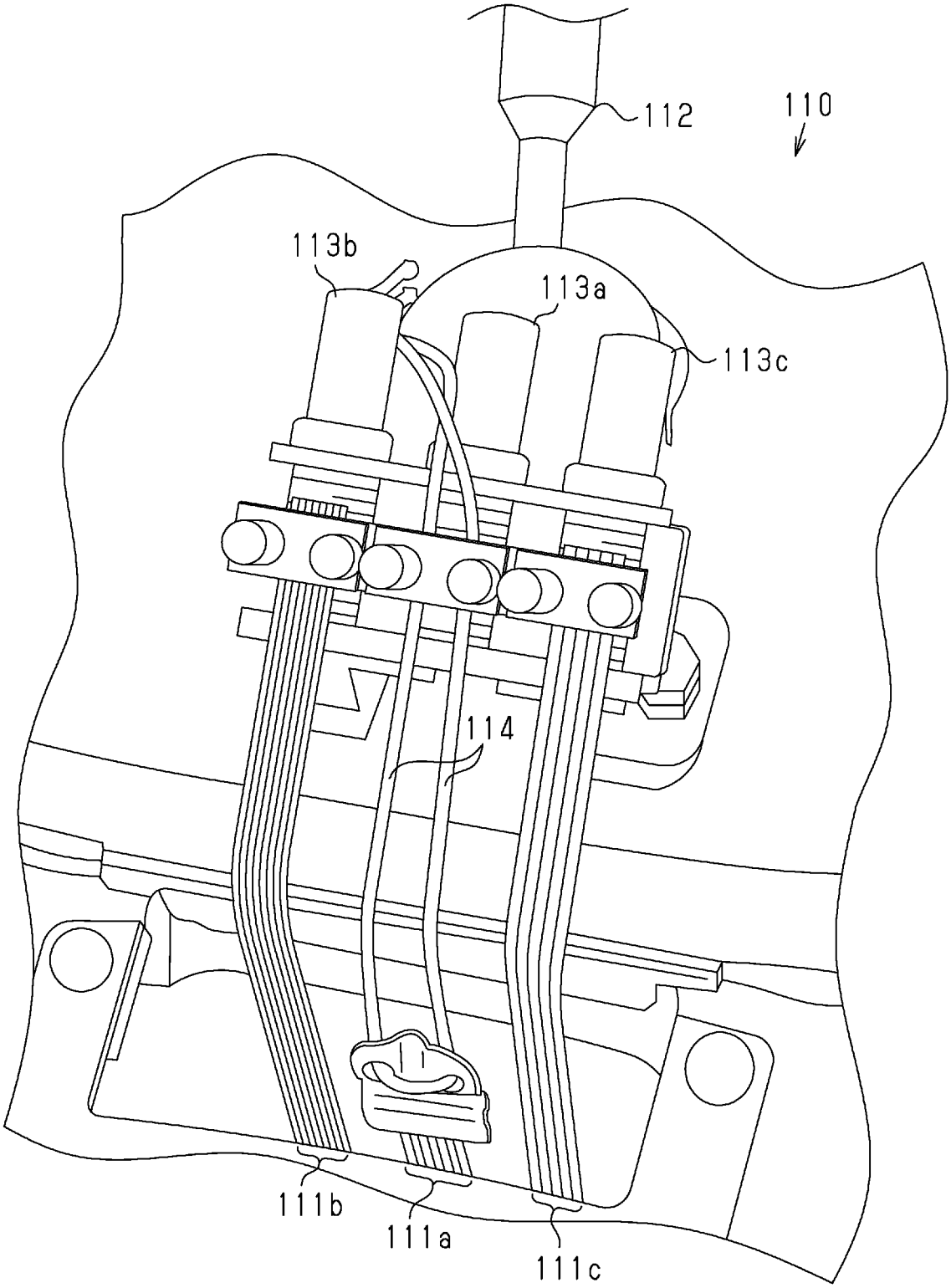
Fig.11(Related Art)
FIG. 11 is a perspective view of a conventional tension adjusting device.

In the present embodiment, the snare drum 10 may include a plurality of tension adjusting devices 40. For example, the three adjustment mechanisms 113*a*, 113*b*, and 113*c* illustrated in FIG. 11 may be replaced with the tension adjusting devices 40.

In the present embodiment, in order to slidably assemble the moving member 42 to the base member 41, the grooves 44*b* are formed in the base member 41 and both the side sections 42*c* of the moving member 42 are engaged with the grooves 44*b*. In lieu of this, grooves may be formed in a moving member 42, portions of a base member 41 may be engaged with the grooves 44*b*, and the moving member 42 may be slidably assembled to the base member 41.

In the present embodiment, the end fixture 22 is fixed between the holder 33 and the clamping member 35, and the snare wire 12 is fixed to the strainer 13. In lieu of this, an end fixture 22 may be directly fixed to a holder 33 by bolts 37 without using a clamping member 35.

In the present embodiment, the shape of the tapered section 25 formed near the first side edge 22*a* of the end fixture 22 may be changed to any shape such as a curved section, a projection, or the like, enabling positioning of the end fixture 22 with respect to the holder 33 and the clamping member 35.

In the present embodiment, the shape of the semicircular cutout 22*c* formed in the second side edge 22*b* of the end fixture 22 may be changed to any shape such as a circular hole, a rectangular cutout, or the like, enabling positioning of the end fixture 22 with respect to the holder 33 and the clamping member 35.

In the present embodiment, the inner sound wire 23 is configured of a straight wire different from the outer sound wire 24; however, may be configured of a straight wire identical to the outer sound wire 24.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

What is claimed is:

1. A snare drum comprising:

a shell having a cylindrical shape;

a pair of drum heads that are mounted on upper and lower opening ends of the shell through hoops;

a snare wire that is attached along the drum head mounted on the lower opening end of the shell and includes a sound wire;

a retainer that is provided on an outer peripheral surface of the shell and to which both ends of the snare wire are fixed; and a tension adjusting device that is attached to at least one of the shell, the hoop, the snare wire, and the retainer and adjusts tension of the snare wire, wherein the tension adjusting device includes a pressing part for pressing the sound wire of the snare wire, and the tension adjusting device is configured to adjust the tension of the snare wire by pressing the sound wire with the pressing part to displace the sound wire in a direction intersecting the sound wire.

2. The snare drum according to claim 1, wherein the tension adjusting device includes a moving member that moves in the direction intersecting the sound wire and an operating unit that is operated when the moving member is moved, and in a state where the tension adjusting device is attached to at least one of the shell, the hoop, the snare wire, and the retainer, the operating unit is disposed between the hoop and the retainer.

3. The snare drum according to claim 2, wherein in a state where the tension adjusting device is attached to at least one of the shell, the hoop, the snare wire, and the retainer, the moving member is disposed closer to the retainer with respect to an intermediate point between the hoop and the retainer.

4. The snare drum according to claim 2, further comprising a tension adjustment mechanism that adjusts the tension of the snare wire by pulling both ends of the snare wire.

5. The snare drum according to claim 2, wherein the tension adjusting device is attached to the retainer.

6. The snare drum according to claim 5, wherein the retainer includes a fixing member that fixes the snare wire to the retainer, and the tension adjusting device is attached to the retainer by the fixing member.

7. The snare drum according to claim 6, wherein the tension adjusting device further includes a base member that is fixed to the retainer, the base member includes a guide section that extends in a direction intersecting the sound wire, and the moving member is slidably assembled to the base member by engaging with the guide section.

8. The snare drum according to claim 1, wherein the tension adjusting device is configured to adjust tension of part of the snare wire.

9. A snare drum comprising:

a shell having a cylindrical shape;

a pair of drum heads that are mounted on upper and lower opening ends of the shell through hoops;

a snare wire that is attached along the drum head mounted on the lower opening end of the shell and includes a sound wire section that is configured of a plurality of sound wires and a pair of end fixtures that is fixed to both ends of the sound wire section; and a retainer that is provided on an outer peripheral surface of the shell and to which end sections of the snare wire are fixed, wherein the retainer includes:

a holder to which the end fixture is fixed; and a clamping member that clamps the end fixture between the clamping member and the holder, the snare wire is attached along the drum head mounted on the lower opening end of the shell by fixing the pair of end fixtures between the clamping member and the holder.

10. The snare drum according to claim 9, wherein the retainer is provided with a positioning section that positions the end fixture with respect to the retainer.

11. The snare drum according to claim 10, wherein the end fixture includes a tapered section near each of a pair of side edges disposed so as to face a longitudinal direction of the snare wire, and the positioning section is configured of the tapered section and inclined surfaces of the retainer and the clamping member that clamp the tapered section when the end fixture is attached to the retainer.

12. The snare drum according to claim 10, wherein the end fixture has a recess in each of a pair of side edges disposed so as to be face a direction orthogonal to a longitudinal axis of the snare wire, the positioning section is configured of the recess and a pair of connecting portions that connect the clamping member and the holder, and the pair of connecting portions are formed at locations corresponding to the recess of the end fixture clamped between the holder and the clamping member.

* * * * *